United States Patent [19]

Alander et al.

[11] Patent Number: 4,784,197

[45] Date of Patent: Nov. 15, 1988

[54] BARKING DRUM AND METHOD OF HEATING SAME

[75] Inventors: Keijo Alander, Järvelä ; Pekka Kokko, Kartano; Tuomas Pontela, Soramäki, all of Finland

[73] Assignee: KONE Oy, Hyvinkaa, Finland

[21] Appl. No.: 37,597

[22] Filed: Apr. 13, 1987

[30] Foreign Application Priority Data

Apr. 23, 1986 [FI] Finland ..... 861596

[51] Int. Cl.[4] ..... B27L 1/00

[52] U.S. Cl. ..... 144/342; 144/208 B

[58] Field of Search ..... 144/208 R, 208 B, 342

[56] References Cited

FOREIGN PATENT DOCUMENTS 634935 11/1978 U.S.S.R. ..... 144/342

660826 5/1979 U.S.S.R. ..... 144/208 B

*Primary Examiner*—W. Donald Bray

*Attorney, Agent, or Firm*—Bell & Arkin

[57] ABSTRACT

For supplying pressurized steam into a rotating barking drum during the barking of tree trunks in order to thaw and warm the bark, steam is supplied into the barking drum from the periphery of the drum in a substantially radial direction through a distribution ring on the periphery of the drum and a stationary member in sliding contact with the ring.

9 Claims, 1 Drawing Sheet

BARKING DRUM AND METHOD OF HEATING SAME

FIELD OF THE INVENTION

The present invention relates to a method for supplying pressurized steam or the equivalent to a rotating barking drum during the barking of tree trunks, in order to thaw and warm the bark, and to a barking drum in which the method is applied.

BACKGROUND OF THE INVENTION

The thawing of timber, either prior to barking or in connection therewith, is indispensable in wintertime in northern regions, particularly when barking birch timber. Presently, such thawing is most commonly effected by warm water, which is supplied into the barking drum. This procedure, or so-called wet barking, results in large quantities of waste water and, in particular, in high contents of biologically oxygen-consuming substances in the waste water. In order to avoid this, the majority of timber treatment installations are provided with a separate thawing conveyor which feeds the timber into the barking drum. On the barking conveyor, the timber is thawed either with warm water or with steam. The first alternative results in waste water quantities at least equal to those incurred in wet barking, but the content in the waste water of substances causing biological oxygen consumption is clearly less. Steam thawing is even more advantageous since it requires a smaller waste water quantity. However, the problems encountered in steam thawing are the achievement of adequate thawing capacity and the high investment required for the barking conveyor.

Efforts to reduce the equipment costs required in timber treatment, and to make the use of energy more efficient, have given rise to the concept of steam thawing in the barking drum. The concept is not entirely novel: such drums have been constructed heretofore, into which steam is supplied in addition to water. In them, the purpose of the steam has mostly been to furnish additional heat during the coldest time of the year. Thawing which is effected entirely by steam has not hitherto been achieved, in the first place owing to the circumstance that it has not been possible to distribute steam over a long enough region within the drum. If it were possible to supply steam into the barking drum in the desired region, it would be possible to improve substantially the thawing capacity, and thereby the barking capacity.

BRIEF SUMMARY OF THE INVENTION

It is accordingly an object of the present invention to provide a procedure for supplying pressurized steam to a barking drum in a novel way so that the above-mentioned problems encountered in apparatus of prior art are voided, as well as a barking drum in which the procedure is applied.

According to the invention, there is provided a method of supplying pressurized steam or the equivalent into a rotating barking drum for barking tree trunks in order to thaw and warm the bark, including the step of supplying the steam from the periphery of the drum in a substantially radial direction into the drum.

Preferably, the steam is supplied from a location at a lower part of the drum on that side of a vertical axis through the drum towards which the drum is rotated.

The invention further provides a rotary barking drum comprising, secured to the periphery of the drum, at least one annular distribution ring, which is narrow in the axial direction of the drum, and at least one substantially stationary means provided on the outside of the distribution ring and in sliding contact therewith or at least close thereto for supplying pressurized steam to the distribution ring.

An advantageous embodiment of the barking drum of the invention, comprises means for dividing the distribution ring into a plurality of mutually separate compartments, distribution ducts extending substantially longitudinally of the drum and affixed to the surface of the drum and steam blowing apertures formed in the distribution ducts through which the steam gains access to the interior of the drum.

In this embodiment of the barking drum of the invention, the distribution ring is formed with elongate apertures at the outer periphery thereof for passage of the steam supply into the compartments.

The compartments are each divided into two parts by a respective partition for directing steam supply in the distribution ducts in opposite longitudinal directions relative to the drum.

The stationary means is located at a lower part of the drum on that side of a vertical axis through said drum towards which said drum rotates.

The procedure of the invention and the barking drum applying it afford several advantages over the state of art. By supplying the steam at a point which is located in the lower part of the drum and on that side of the drum's vertical axis towards which the drum rotates, the advantage is gained that the pressurized steam enters under the timber mass because obviously, as the drum rotates, the timber mass tends to accumulate at this particular point, whereby the effect of the steam will be maximally utilized and unnecessary escape of steam is avoided.

It is possible with the aid of the distribution ducts to spread the steam over a long enough region, thus ensuring adequate thawing capacity. Likewise, the steam can be introduced into an efficient inner part of the drum, thereby incurring minimal tendency to escape. It is a highly important advantage that the present apparatus may be easily added to existing barking drums. Moreover, its installation is rapidly accomplished. The fact that the thawing takes place inside the drum enables the supply means to be chosen with complete freedom.

BRIEF DESCRIPTION OF THE DRAWINGS

In the following, an embodiment of the invention is described in detail, by way of example only, with reference to the attached drawing, wherein.

DESCRIPTION OF THE PREFERRED EMBODIMENT

Figure 1:
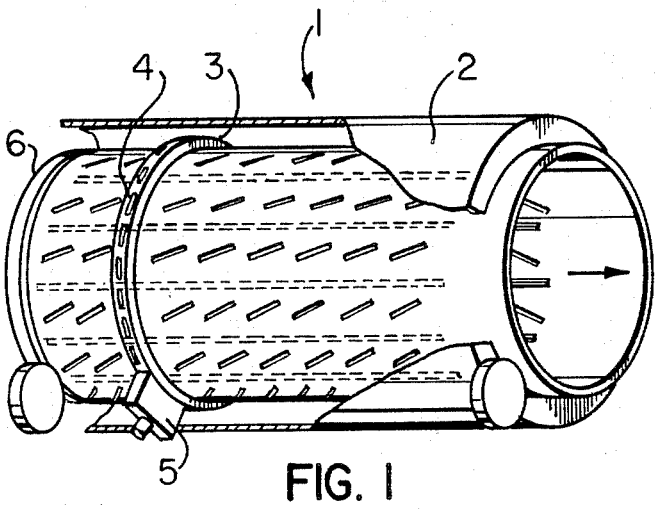
FIG. 1 shows a view, in perspective of a barking drum embodying the present invention, provided with a steam supply.

In FIG. 1 there is depicted a rotating barking drum 1 embodying the present invention, surrounded by a protective shell 2, which however has been almost completely broken-away for easier explanation of the apparatus. On the barking drum there is mounted, preferably by welding, a fairly narrow, e.g. about 400 mm wide, hollow distribution ring 3. On the outer surface of the distribution ring, elongate apertures 4 have been provided. The distribution ring has been disposed fairly close to an input end 6 of the barking drum through which a timber mass to be barked is introduced into the drum, e.g. about 1–3 m distant therefrom. The distance of the distribution ring from an output end 7 of the drum is most advantageously about 10–15 m, depending on the size of the barking drum.

In contact with the distribution ring, or at least very close to it, has been disposed a steam supplying member 5. The most advantageous location of the steam-supplying member 5 is about 20°–40° beyond the lowest point of the drum in the direction of its rotation, as can best be seen in FIG. 2. As a rule no more than one supplying member per drum is required. The location of the supplying member is constant regardless of the drum's rotation. It is possible to suspend the supplying member so that it is sprung for resilient displacement in a direction extending radially of the drum, the supplying member being urged by a spring force against the distribution ring 3 with constant force.

Figure 2:
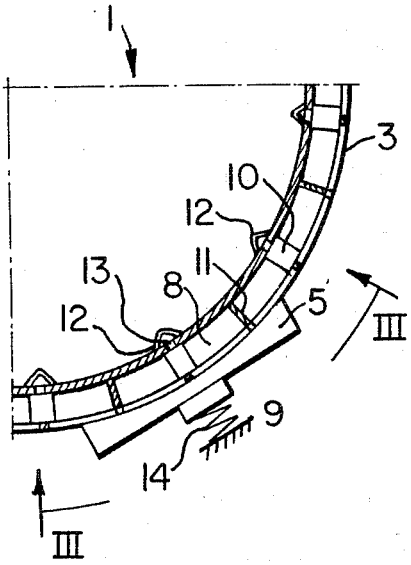
FIG. 2 shows a view in cross-section of part of a distribution ring connected to a barking drum.
Figure 3:
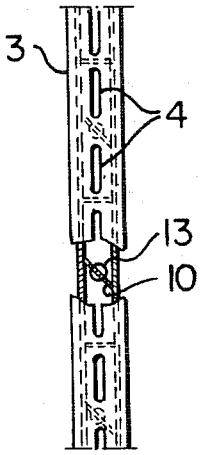
FIG. 3 shows the distribution ring of FIG. 2, viewed in the direction of arrows III—III and partly in cross-section.

In FIG. 2, a part of the distribution ring is depicted in cross-section. FIG. 2 shows that, in the distribution ring, a plurality of mutually similar compartments 8 have been formed with the aid of walls 11. Each compartment is divided into two parts by the aid of an oblique partition 10 (FIG. 3). Steam flows in from the supplying member 5, from a blowing mouth 9. The steam passes through the apertures 4 in the outer surface of the distribution ring 3, when the barking drum rotates counter-clockwise as seen in FIG. 2, into that compartment 8 which is opposite the blowing mouth 9 of the supplying member 5 at the particular instant. From the compartment, the steam discharges through holes 13, guided by the partition 10, into distribution pipes or ducts 12, provided on the inner surface of the barking drum and extending longitudinally of the drum. Since the partitions 10 are oblique, the steam will be directed in both directions longitudinally of the drum.

The distribution pipes 12, which have been disposed uniformly around the entire inner circumference of the drum and each extend, as shown, over a substantial portion of the length of the drum 1, have been provided with blowing holes (not visible in the figures) through which the steam gains access to the interior space of the drum 1. It has been found that it is advantageous to arrange the blowing holes so that they form spiral configurations within the drum 1. It is further pointed out that the distribution pipes 12 need not extend over the whole length of the drum 1 but only as far as the region of steam action is desired to extend.

The mode of operation of the above-described steam supply is as follows. When the barking drum 1 rotates, the distribution ring 3, which is welded thereon or otherwise permanently attached thereto, also rotates. The supplying member 5 for pressurized, hot steam blows steam under constant pressure towards the distribution ring. In the embodiment depicted in the figures, as the distribution ring rotates, either one or two elongate apertures 4 are in register with the blowing mouth 9 of the supplying member 5 at any time, the pressurized hot steam passing through these apertures 4 into one of the compartments 8 which is passing by at that particular moment. From the compartment 8, the steam is distributed in the manner already described, along the system of distribution pipes 12, in the inside of the drum, under the timber mass.

It will be apparent to those skilled in the art that the invention is not confined to the embodiment presented in the foregoing and that it may be varied within the scope of the claims following below. For instance, the supplying member 5 need not be in sliding contact with the distribution ring 3: it is equally possible for it to be located at a small distance therefrom. For instance it may be carried by small wheels provided on the ends of the supplying member. There is also a great number of other alternatives regarding mounting of the supplying member. It is likewise obvious that the distribution pipes need not be located inside the drum: they may alternatively be located outside the drum, in which case they open on the inner surface of the drum, at the points of steam supply.

We claim:

1. A method of supplying pressurized steam or the equivalent into a rotating barking drum for barking tree trunks in order to thaw and warm the bark, including the step of feeding the steam longitudinally of the periphery of said drum and discharging the steam from the periphery of said drum in a substantially radial direction into said drum at locations spaced apart along a substantial portion of the length of said drum.

2. A method according to claim 1, wherein the steam is supplied from a location at a lower part of said drum on that side of a vertical axis through said drum towards which said drum is rotated.

3. A rotary barking drum comprising, secured to the periphery of said drum, at least one annular distribution ring, which is narrow in the axial direction of said drum, at least one substantially stationary means provided on the outside of said distribution ring and in sliding contact therewith or at least close thereto for supplying pressurized steam to said distribution ring, and means defining a plurality of distribution passages communicating with said annular distribution ring and extending longitudinally of said drum for discharging the steam radially into the interior of said drum at locations distributed along a substantial portion of the length of said drum.

4. A rotary barking drum according to claim 3, further comprising means for dividing said distribution ring into a plurality of mutually separate compartments, distribution ducts extending substantially longitudinally of said drum and affixed to the surface of said drum and steam blowing apertures formed in said distribution ducts through which the steam gains access to the interior of said drum.

5. A rotary barking drum according to claim 3, wherein said distribution ring is formed with elongate apertures at the outer periphery thereof for passage of the steam supply into said compartments.

6. A rotary barking drum according to claim 3, wherein said compartments are each divided into two parts by a respective partition for direction steam supply in said distribution ducts in opposite longitudinal directions relative to said drum.

7. A rotary barking drum according to claim 3, wherein said stationary means is located at a lower part of said drum on that side of a vertical axis through said drum towards which said drum rotates.

8. A rotary barking drum according to claim 3, wherein said distribution ring is located closer in the longitudinal direction of said drum, to an input end of said drum than to an output end of said drum.

9. A rotary barking drum according to claim 8, the distance of said distribution ring from said input end of said drum is 1–3 m and that from said output end if 10–15 m.

* * * * *